US006517404B1

(12) United States Patent
Lamouri et al.

(10) Patent No.: US 6,517,404 B1
(45) Date of Patent: Feb. 11, 2003

(54) HIGH INTENSITY DISCHARGE LAMPS, ARC TUBES AND METHODS OF MANUFACTURE

(75) Inventors: Abbas Lamouri, Fairview Park; Juris Sulcs, Chagrin Falls; Yongwei Gu, Solon, all of OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 09/866,700

(22) Filed: May 30, 2001

Related U.S. Application Data

(63) Continuation-in-part of application No. 09/800,669, filed on Mar. 8, 2001.

(51) Int. Cl.[7] ..... H01J 9/395; H01J 9/40
(52) U.S. Cl. ..... 445/26; 445/39; 445/43
(58) Field of Search ..... 445/26, 39, 43

(56) References Cited

U.S. PATENT DOCUMENTS 3,211,511 A * 10/1965 Levand ..... 445/27
4,799,912 A * 1/1989 Salgo ..... 445/26
5,075,587 A 12/1991 Pabst et al.
5,108,333 A 4/1992 Heider et al.
5,221,876 A 6/1993 Bergman et al.
5,505,648 A 4/1996 Nagasawa et al.
5,668,441 A 9/1997 Genz

OTHER PUBLICATIONS

Hansler and Davenport, Journal of the Illuminating Engineering Society, pp. 109–122, Fall, 1985.

* cited by examiner

*Primary Examiner*—Kenneth J. Ramsey
(74) *Attorney, Agent, or Firm*—Duane Morris LLP; D. Joseph English; L. Lawton Rogers, III

(57) ABSTRACT

A tipless arc tube for a high intensity discharge lamp and method of manufacture wherein the arc tube may remain open to an uncontrolled atmosphere during the step of hermetically scaling the arc tube. The novel arc tube and method obviate the need to perform any process steps within a controlled atmosphere. The pressure of the fill gas sealed within the arc tube may be controlled by controlling the temperature of the fill gas during the step of hermetically sealing the arc tube. The novel arc tube and method obviate the need to use a pump to control the fill gas pressure.

40 Claims, 15 Drawing Sheets

HIGH INTENSITY DISCHARGE LAMPS, ARC TUBES AND METHODS OF MANUFACTURE

RELATED APPLICATIONS

This application is a continuation-in-part of application Ser. No. 09/800,669 filed Mar. 8, 2001, assigned to the assignee of the present invention.

BACKGROUND OF THE INVENTION

The present invention generally relates to high intensity discharge ("HID") lamps, arc tubes, and methods of manufacture. More specifically, the present invention relates to HID lamps, arc tubes, and methods of manufacture wherein the pressure of the fill gas in the arc tube is greater than one atmosphere at substantially room temperature.

HID lamps have been developed as a point source and are particularly suited for fiber optic lighting systems, projection display, and automotive headlamps. Metal halide lamps with xenon as a fill gas have been favored in many applications because of the instant light capability, relatively long life, and relatively high efficiency in producing white light with good color rendition.

In the manufacture of HID lamps for point sources, it is desirable to obtain a final fill gas pressure which is greater than one atmosphere at substantially room temperature. Final fill gas pressures greater than about five atmospheres are common and fill gas pressures may be as high as about six hundred atmospheres.

In the manufacture of xenon metal halide lamps, it is known to obtain a superatmospheric xenon pressure by freezing an amount of xenon into the light emitting chamber of the lamp prior to sealing the chamber. The volume of xenon frozen into the chamber (when at substantially one atmosphere and room temperature) is larger than the volume of the chamber so that the pressure of the xenon sealed within the chamber is greater than one atmosphere when the temperature of the xenon returns to substantially room temperature. The pressure (in atm) of the fill gas sealed within the chamber at substantially room temperature equals the ratio of the volume of gas frozen into the chamber (at substantially one atmosphere and room temperature) relative to the volume of the chamber.

In the known methods of making superatmospheric arc tubes, the prior art teaches that the interior of the arc tube body must be isolated from an uncontrolled atmosphere once the solid fill material and mercury are introduced into the interior of the arc tube body and the second electrode lead assembly is positioned in the remaining open end portion to prevent oxidation of the metallic components of the second electrode lead assembly during the sealing process of the second end portion.

The prior art teaches that the interior of the arc tube may be isolated from an uncontrolled atmosphere by either (i) placing the arc tube body in a controlled atmosphere such as a glove box as taught in U.S. Pat. No. 5,108,333 to Heider et al. dated Apr. 28, 1992 or (ii) connecting the open end to a vacuum system which provides the necessary seal as taught in U.S. Pat. No. 5,505,648 to Nagasawa et al. dated Apr. 9, 1996.

As disclosed in Heider et al., one end portion of the arc tube body must be long enough to enclose the entire electrode lead assembly when the assembly is positioned within the end portion. Once the arc tube is placed within the controlled atmosphere of the glove box, the body is filled with xenon and then the end portion is fused closed so that the entire electrode lead assembly is enclosed within the body. The arc tube may then be removed from the glove box so that the xenon may be frozen into the chamber and then sealed by shrinking or pinching the second end portion. The excess portion of the end portion is then removed to expose the outer lead of the electrode lead assembly.

The prior art methods suffer from the significant disadvantage of the requirement for isolating the arc tube body from the uncontrolled atmosphere. This has generally required the use of a glove box or vacuum system. Such methods are complex and difficult to automate.

Accordingly, it is an object of the present invention to obviate many of the deficiencies of the prior art and provide a novel HID lamp, arc tube and method of making arc tubes.

It is another object of the present invention to provide a novel arc tube and method of making arc tubes for HID lamps which obviates the need to perform any process steps within a controlled atmosphere.

It is a further object of the present invention to provide a novel arc tube and method of making tipless arc tubes for HID lamps in which the arc tube remains open to an uncontrolled atmosphere during the step of finally sealing the arc tube.

It is yet another object of the present invention to provide a novel arc tube and method of making tipless arc tubes for HID lamps in which communication of an inert fill gas with an uncontrolled atmosphere such as air is maintained until the arc tube is hermetically sealed.

It is yet a further object of the present invention to provide a novel arc tube and method of making arc tubes for HID lamps which obviates the need to remove a portion of the end portion to expose the outer portion of the electrode lead assembly.

It is still another object of the present invention to provide a novel arc tube and method of making arc tubes for HID lamps in which each end portion of the arc tube body has substantially the same length as the end portions of the finished arc tube.

It is still a further object of the present invention to provide a novel apparatus for extending the tubular opening formed by the end portion of an arc tube body and method of making arc tubes for HID lamps.

It is still another object of the present invention to provide a novel arc tube and method of making arc tubes for HID lamps in which the temperature of the fill gas is controlled prior to sealing the arc tube in an uncontrolled atmosphere.

It is yet another object of the present invention to provide a novel arc tube and method of making arc tubes for HID lamps having superatmospheric fill pressure in which there is no pressure differential at the time of sealing.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

The present invention finds utility in arc tubes for all types and sizes of HID lamps and methods of manufacture of such lamps generally. By way of example only, certain aspects of the present invention will be described in connection with tipless quartz formed body arc tubes for double-ended metal halide lamps.

Figure 1:
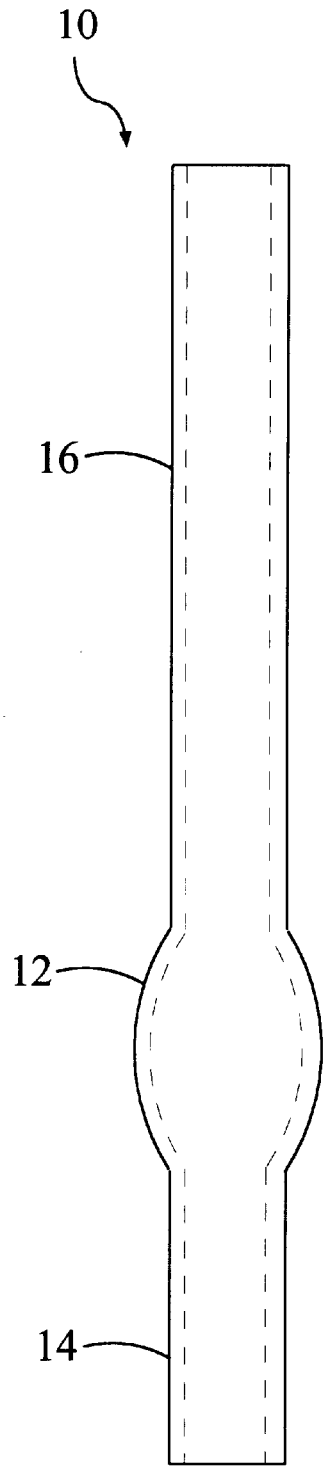
FIGURE 1 PRIOR ART
FIG. 1 is a cross-sectional view of an arc tube body having a bulbous light emitting chamber.

FIG. 1 illustrates a prior art arc tube body which has been formed from a quartz tube. The arc tube body 10 comprises a bulbous light emitting chamber 12 intermediate open tubular end portions 14,16. The arc tube body 10 may be formed using any suitable conventional method.

Figure 2A:
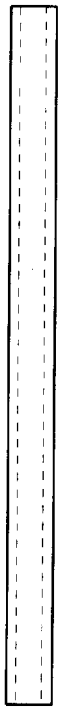
FIGURE 2A PRIOR ART
FIGS. 2*a–e* illustrate the prior art process steps for forming the arc tube body illustrated in FIG. 1.
Figure 2B:
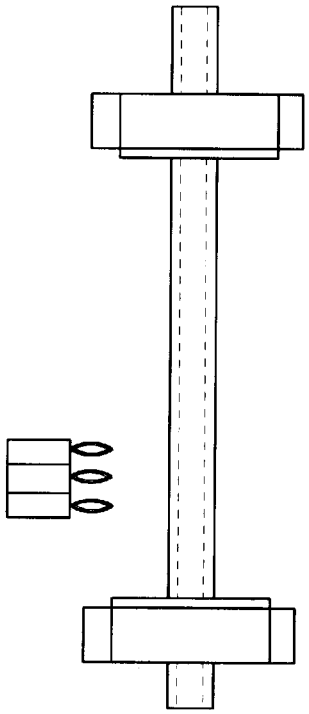
FIGURE 2B PRIOR ART
Figure 2C:
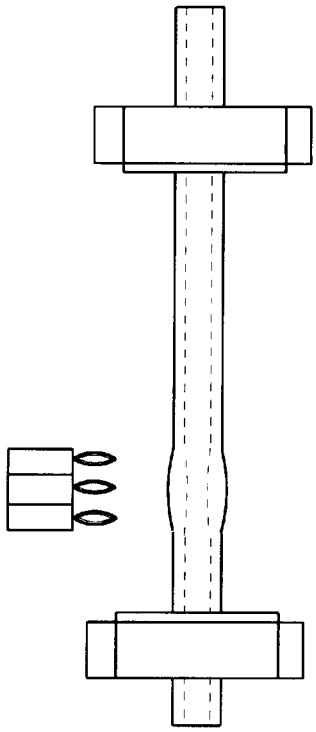
FIGURE 2C PRIOR ART
Figure 2D:
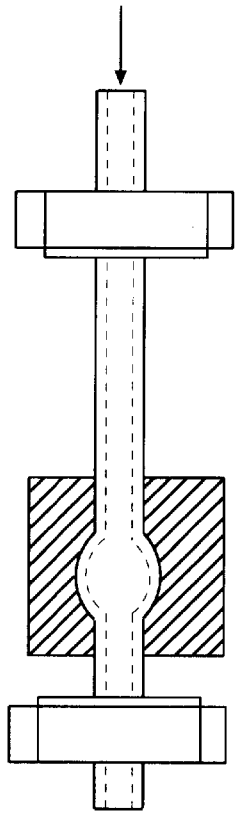
FIGURE 2D PRIOR ART
Figure 2E:
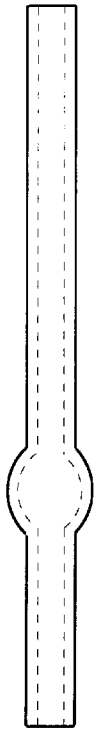
FIGURE 2E PRIOR ART

Formed body arc tubes may be manufactured in the manner described in the Lamouri et al. copending patent application Ser. No. 09/597,547 filed Jun. 19, 2000, and entitled "Horizontal Burning HID Lamps And Arc Tubes" assigned to the assignee of the present invention. FIGS. 2*a–e* illustrate such a method of forming arc tubes from quartz tubing (FIG. 2*a*) by loading the tubing on a lathe and heating the tubing (FIG. 2*b*), gathering the heated tube by axial movement of the tube (FIG. 2*c*), and expanding with internal pressure the gathered tube against a mold (FIG. 2*d*) to obtain the desired shape of the arc tube body (FIG. 2*e*). The thickness of the arc tube body may be adjusted by the amount of quartz accumulated in the gathering process and the shape of the arc tube body is determined by the shape of the mold.

Figure 3A:
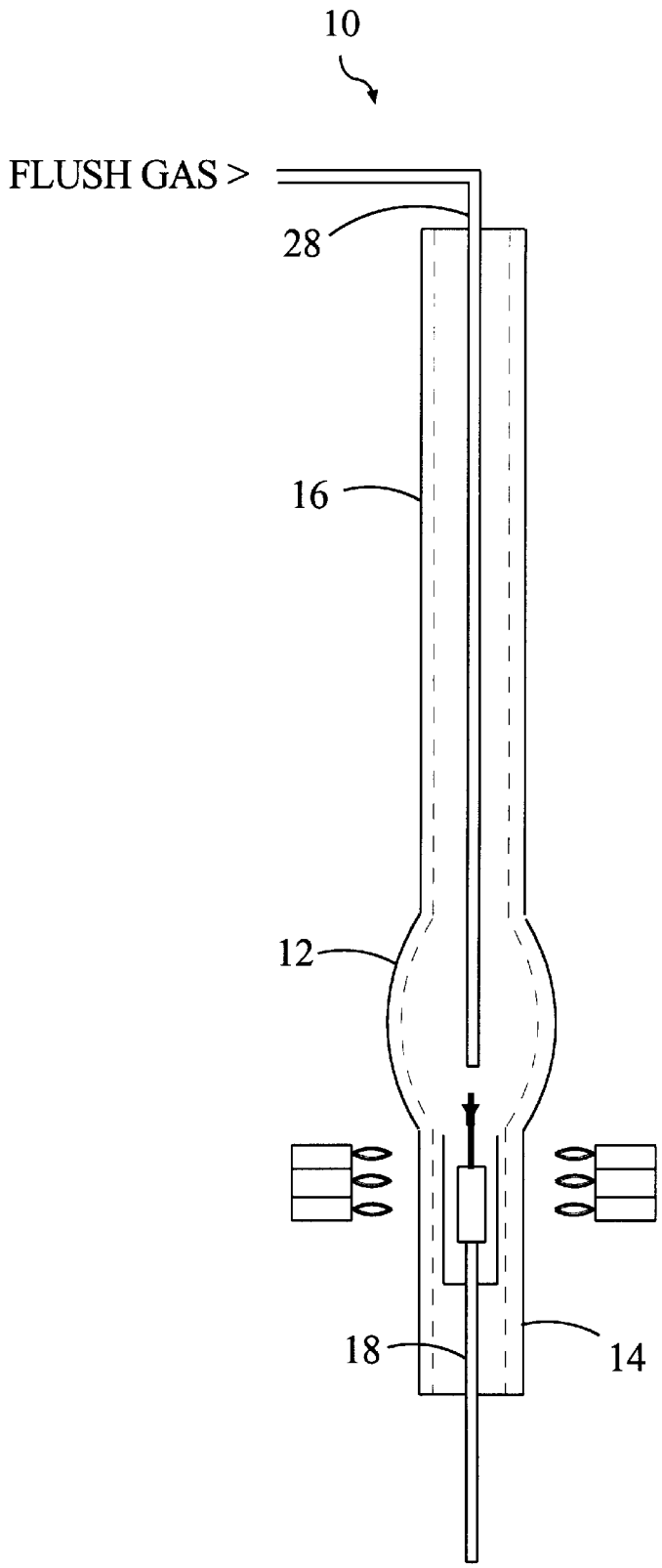
FIG. 3*a* illustrates the step of heating the end portion of an arc tube body while flushing the interior of the body with an inert gas during the pinch sealing process.
Figure 3B:
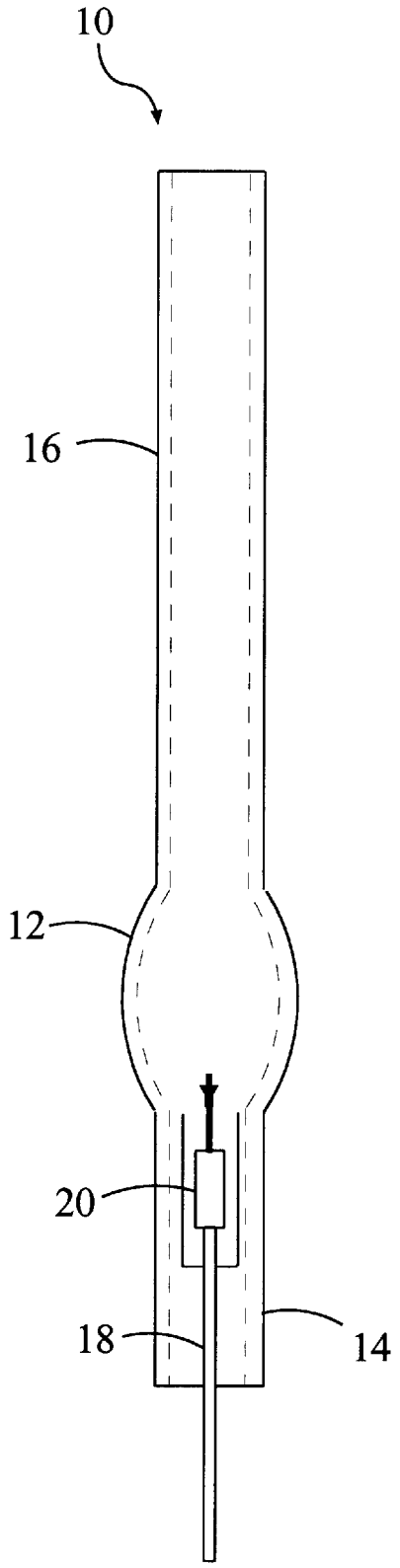
FIG. 3*b* is a cross-sectional view of an arc tube body having an electrode lead assembly pinch sealed in one end.

As shown in FIGS. 3*a* and 3*b*, a first electrode lead assembly 18 is positioned within the open tubular end portion 14 and the end portion 14 is sealed using a conventional pinch sealing process. During the pinch sealing process, a portion of the end portion 14 is heated to soften the quartz, and then the softened portion is pressed together and around the portion of the electrode lead assembly 18 positioned therein using conventional pinch jaws (not shown) forming pinch seal 20. The pinch seal 20 fixes the position of the assembly 18 relative to the arc tube body 10 and provides a hermetic seal between the interior of the chamber 12 and the exterior of the body 10 through the end portion 14.

Figure 4:
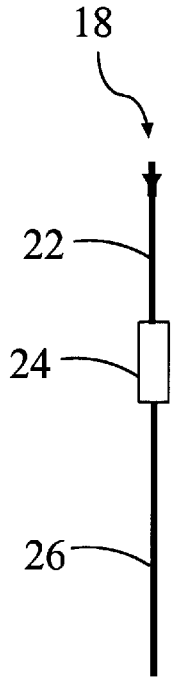
FIG. 4 is a schematic illustrating an electrode lead assembly.

The electrode lead assembly 18 may be a conventional lead assembly comprising several metallic components including a tungsten electrode 22, a molybdenum foil 24, and a molybdenum outer lead 26 as shown in FIG. 4. During the pinch sealing process, the metallic components may reach temperatures as high as 2000° C. or more when the quartz is softened. At such high temperatures, the metallic components are highly susceptible to corrosion if exposed to moisture in a reactive atmosphere such as air. To prevent such corrosion, an inert gas is introduced into the chamber 12 through the remaining open tubular end portion 16 and flows past the lead assembly 18 during the pinch sealing process. The gas may be introduced by any conventional means such as insertion of a probe 28 as shown in FIG. 3*a* or the connection of a hose (not shown) to the open end portion 16. The gas may be any inert gas such as nitrogen or argon or mixtures thereof.

Figure 5:
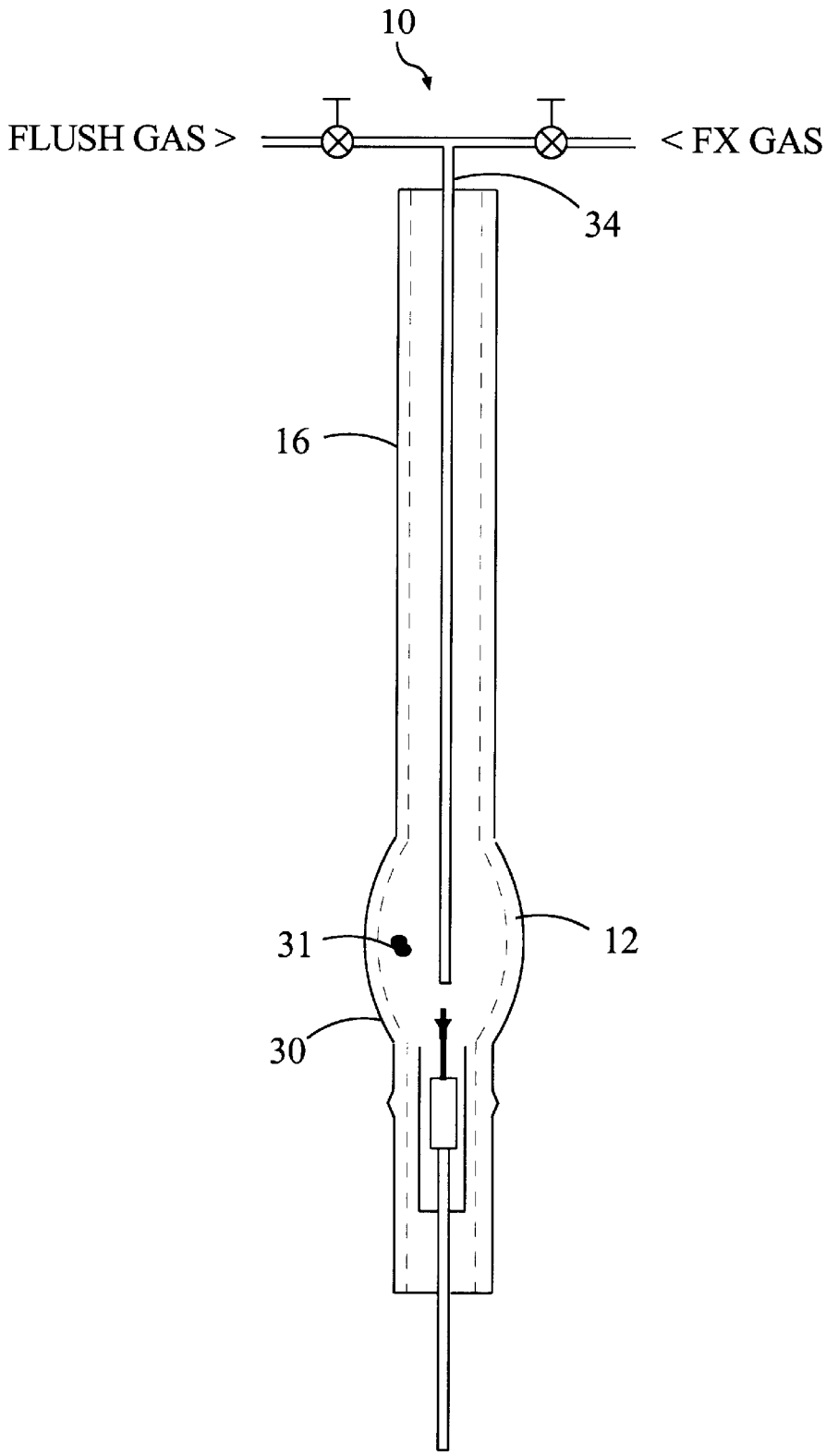
FIG. 5 illustrates the step of introducing the solid lamp fill material and mercury into the interior of the chamber.

The next step is to dose the arc tube body with the desired fill material by introducing the material into the chamber 12 through the remaining open end portion 16. The solid lamp fill material 30 may be introduced into the chamber 12 through the remaining open end portion 16 by any conventional means such as a pin type dispenser of lamp fill pellets manufactured by APL Engineered Materials, Inc. Mercury 31, if desired, may also be introduced into the chamber 12 through the end portion 16 by any conventional means. FIG. 5 illustrates an arc tube body 10 having lamp fill pellets 30 and mercury 31 within the chamber 12.

The remaining steps in the process include the flushing and filling of the chamber with the final fill gas, the positioning of the second electrode lead assembly in the remaining open end portion, and the sealing of the remaining open end portion. As discussed with respect to the pinch sealing of the first end portion, it is important to prevent the exposure of the metallic components of the electrode lead assembly to a corrosive atmosphere at high temperature.

Figure 6:
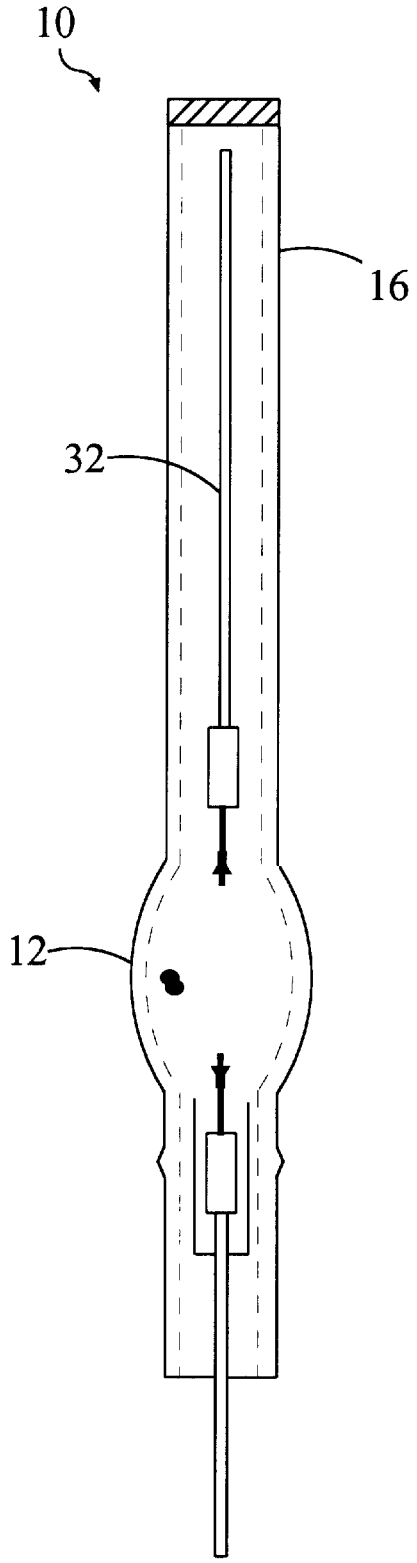
FIGURE 6 PRIOR ART
FIG. 6 is a cross-sectional view of a prior art arc tube body having its elongated end portion tipped off beyond the electrode lead assembly.

The prior art methods teach the necessity to isolate the components from an uncontrolled atmosphere by either (i) placing the arc tube body in a glove box, or (ii) connecting the open end of the arc tube body to a vacuum system prior to filling the interior of the arc tube body with the final fill gas and positioning the second electrode lead assembly. As shown in FIG. 6, the open end portion 16 may be fused closed outside the lead assembly 32 once the final fill pressure is obtained to isolate the interior of the chamber 12 containing an inert atmosphere. Thus the prior art prevents corrosion of the metallic components of the lead assembly during the pinch sealing of the end portion 16 by isolating the components in an inert atmosphere within the interior of the arc tube body.

Figure 7:
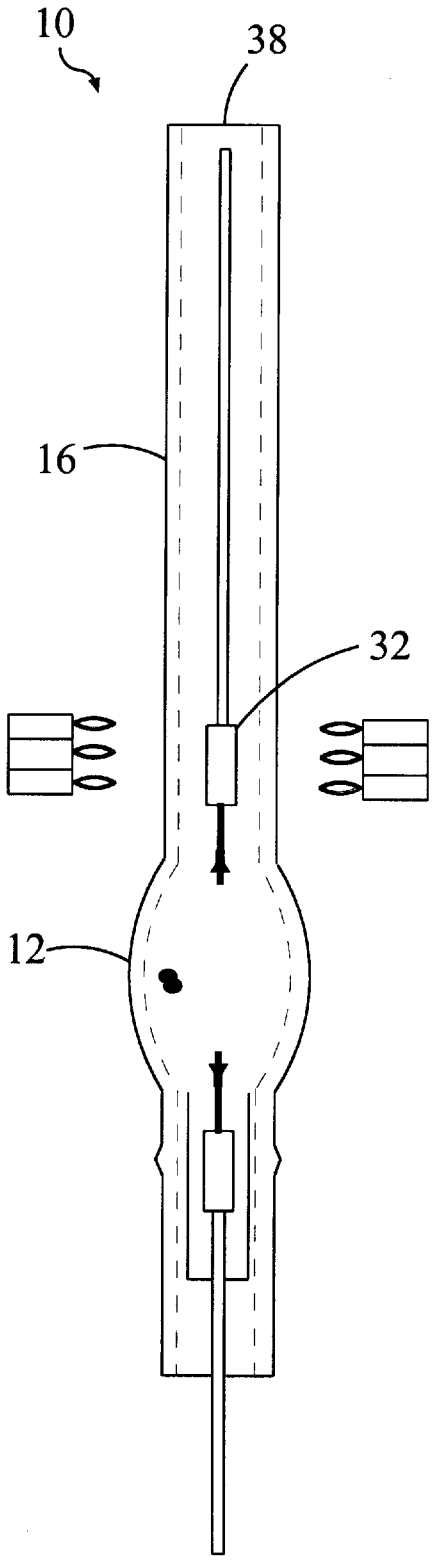
FIG. 7 illustrates the step of heating the upper end portion of an arc tube body while maintaining the interior of the body open to the surrounding atmosphere.

It has been discovered that the isolation of the interior of the arc tube from an uncontrolled atmosphere by use of a glove box or vacuum system may be obviated by orienting the arc tube body 10 so that the open end portion 16 extends upwardly as shown in FIGS. 5 and 7, and relying on the relative weight of the fill gas to air to maintain a fill of inert gas within the arc tube body. The final inert fill gas may be introduced into the interior of the chamber 12 by insertion of a suitable conventional probe 34. The fill gas may be any inert gas such as argon, neon, xenon, krypton, or a combination thereof. In the preferred embodiment of the present invention, the fill gas is xenon or a mixture of xenon and argon, both of which are heavier than air and will tend to remain within the interior of the arc tube body 10 so long as the body remains in a substantially vertical orientation, thus retarding the influx of the lighter contaminated air of the uncontrolled atmosphere surrounding the arc tube.

The interior of the arc tube body 10 is flushed and filled with the fill gas to the tip 38 of the end portion 16 so that all other gases are displaced. Once the arc tube body is flushed and filled, the probe 34 may be removed and the second electrode lead assembly 32 is positioned within the end portion 16 as shown in FIG. 7. The end portion 16 must extend sufficiently above the lead assembly 32 so that the lead assembly 32 will remain immersed in the column of fill gas within the end portion 16 despite some mixing of the fill gas with the uncontrolled atmosphere surrounding the arc tube body near the tip 38 of the end portion 16.

Figure 8:
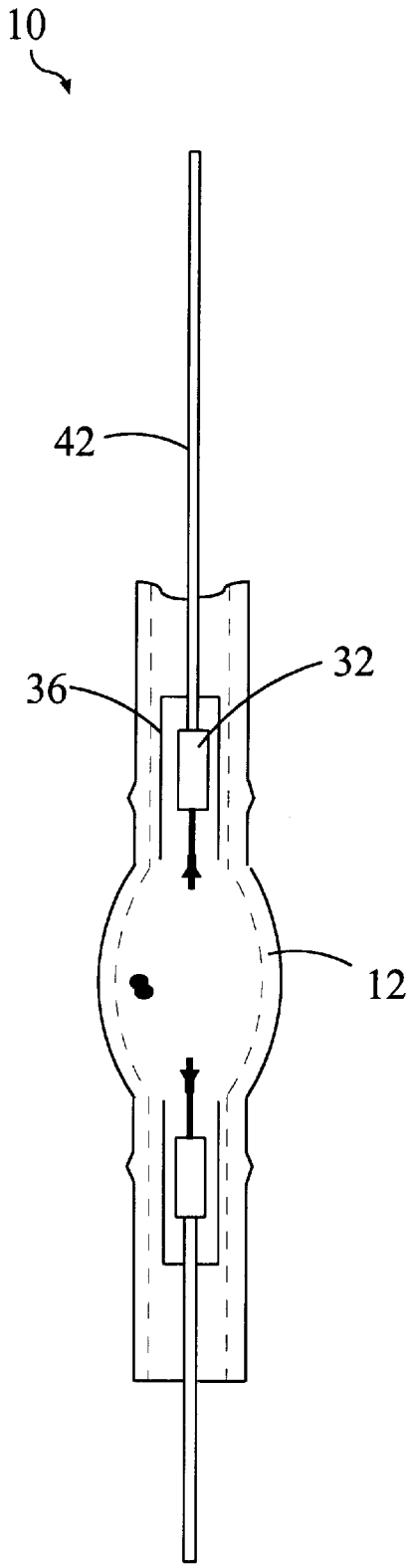
FIG. 8 is a cross-sectional view of an arc tube made by one method of the present invention.

As shown in FIGS. 7 and 8, the second end portion 16 may then be sealed by a conventional pinch sealing process. A portion of the end portion 16 is heated to soften the quartz, and then the softened portion is pressed together and around the portion of the electrode lead assembly 32 positioned therein using conventional pinch jaws (not shown) forming pinch seal 36. The pinch seal 36 fixes the position of the assembly 32 relative to the arc tube body 10 and provides a hermetic seal between the interior of the chamber 12 and the exterior of the body 10 through the end portion 16. In another embodiment, the end portion may be sealed by a shrink sealing process.

As further illustrated in FIG. 8, the chamber 12 is now hermetically sealed from the exterior of the arc tube body 10. The excess portion of the end portion 16 may then be removed to expose the outer lead 42 of the electrode lead assembly 32.

Figure 9:
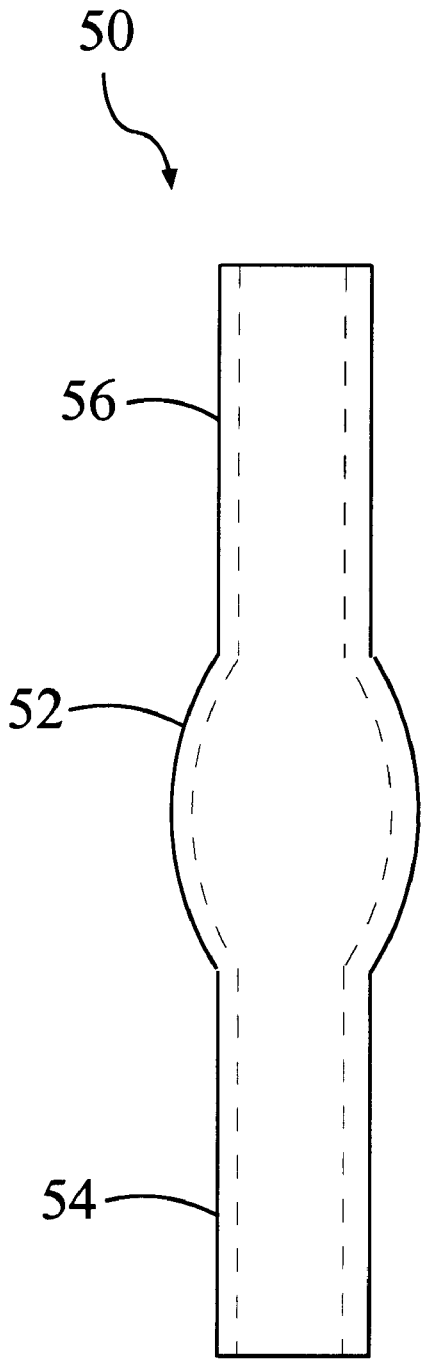
FIG. 9 is a cross-sectional view of one embodiment of an arc tube body according to the present invention.
Figure 10:
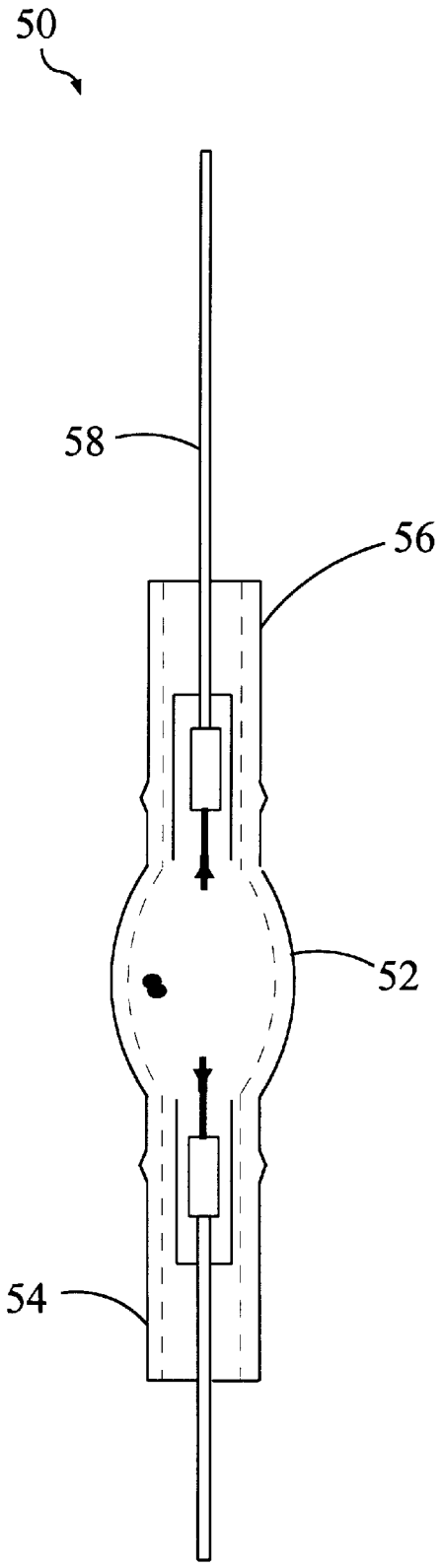
FIG. 10 is a cross-sectional view of an arc tube made from the arc tube body illustrated in FIG. 9.

FIGS. 9 and 10 illustrate another embodiment of the present invention. The arc tube body 50 may be formed having a chamber 52 intermediate the open end portions 54,56. The end portions 54,56 may have substantially the same length. In the preferred embodiment, the length of the end portions 54,56 of the arc tube body 50 may be substantially the length of the end portions of the finished arc tube so that the step of trimming the excess portion of the second end portion once the chamber is sealed may be eliminated. However, it remains necessary to provide a column of fill gas which is sufficiently long so that the second electrode lead assembly 58 positioned within the second end portion 56 is completely immersed in fill gas during the pinch sealing process of the second end portion.

In one embodiment of the present invention, the column of fill gas may be extended beyond the length of the end portion by communication of the open end portion with a mechanical means forming an elongated shaft having substantially the same diameter as the outside diameter of the end portion. In the embodiment shown in FIGS. 11*a* and 11*b*, a flush and fill block 60 forms a main shaft 62 which communicates with the open end portion 56 of the arc tube body 50 during the steps of positioning the electrode lead assembly 58, flushing/filling the body 50 with the final fill gas, and pinch sealing the end portion 56.

Figure 11A:
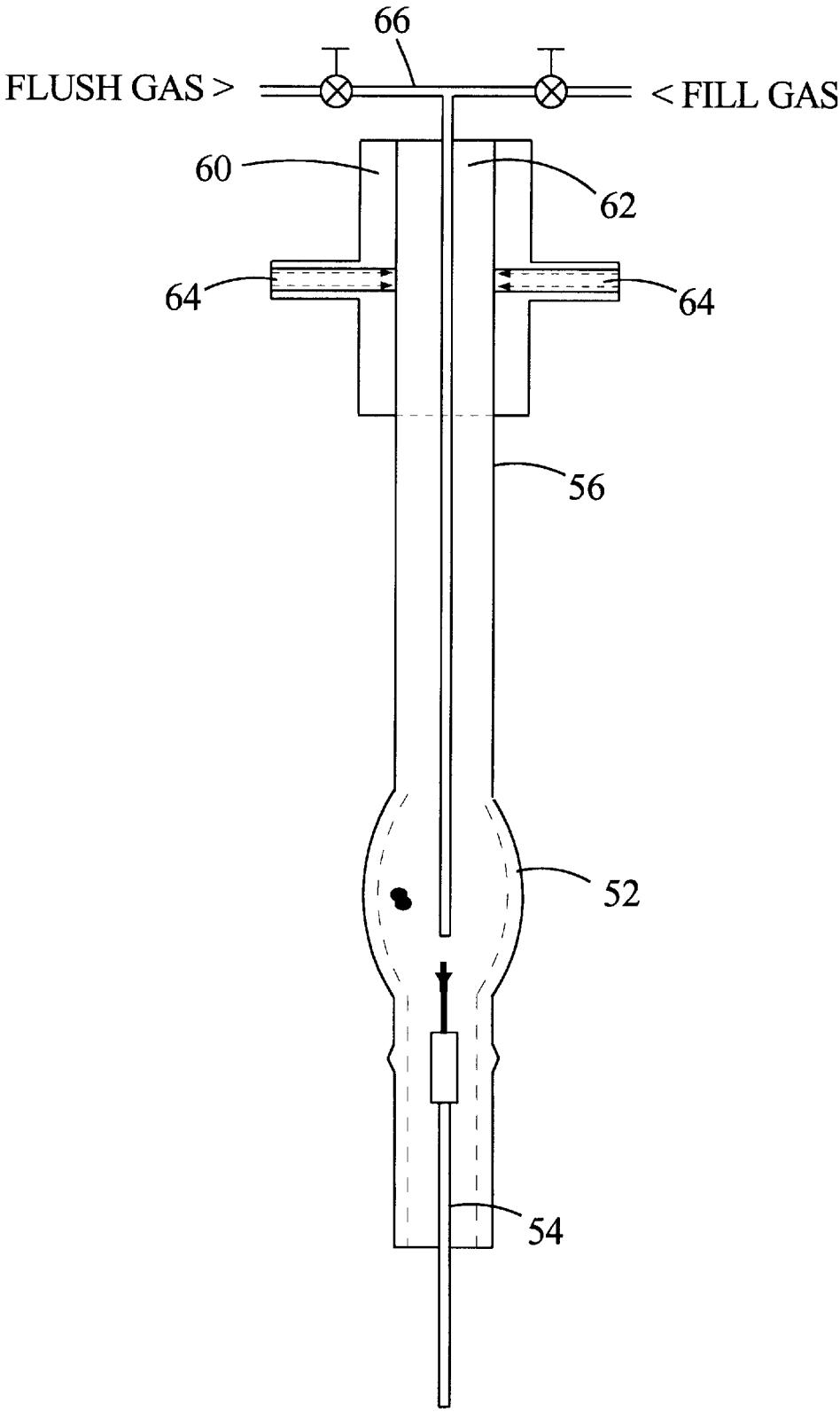
FIG. 11*a* illustrates the step of flushing and filling the arc tube body with the final fill gas according to the present invention.

The block 60 forms the main shaft 62 and one or more auxiliary shafts 64 which provide communication between the main shaft 62 and the surrounding atmosphere. The open end of the end portion 56 may be positioned relative to the block 60 to effect communication of the main shaft 62 with the tubular opening formed by the end portion 56. The interior of the arc tube chamber 52 and open end portion 56 may be flushed and filled with the final fill gas by insertion of a conventional probe 66 into the chamber 52 as shown in FIG. 11*a*.

Figure 11B:
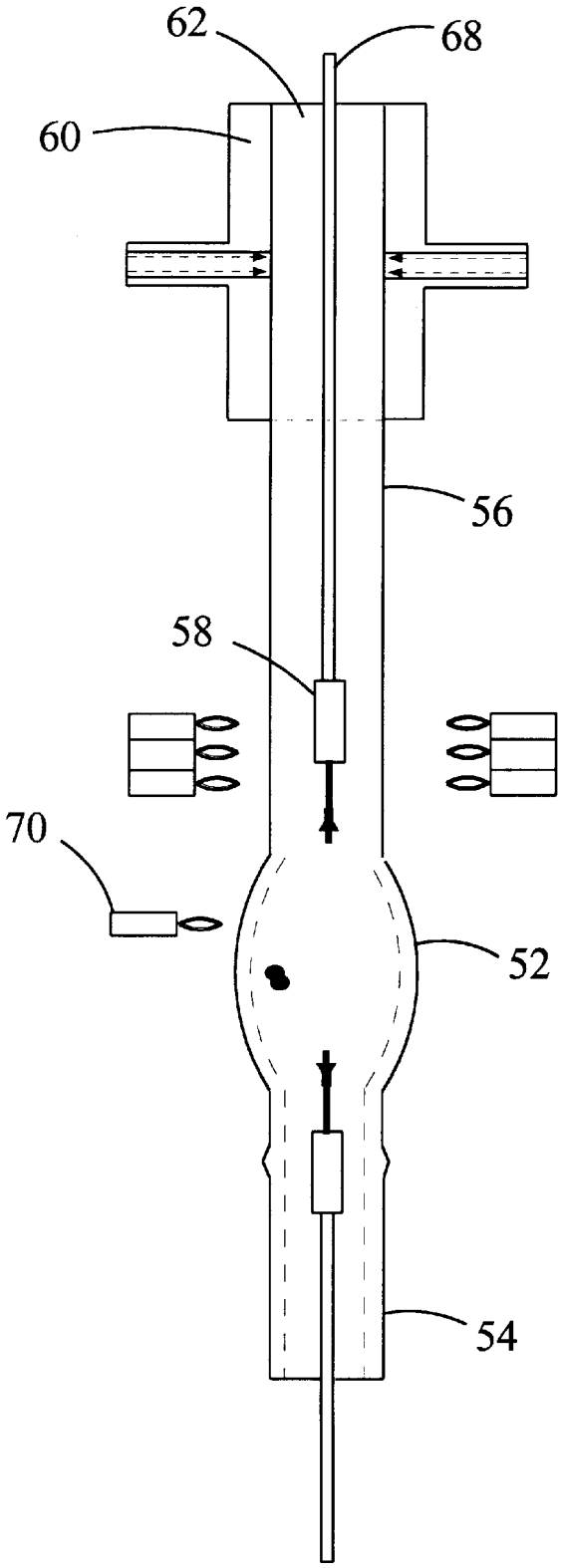
FIG. 11*b* illustrates the steps of positioning the electrode lead assembly and pinch sealing the second end portion of the arc tube according to one aspect of the present invention.

Once the arc tube body 50 is flushed and filled with the final fill gas, the probe 66 may be removed. The fill gas now fills the end portion 56 and the main shaft 62 and tends to remain within the shaft 62 as a result of the relative weight of the fill gas to the surrounding atmosphere. The electrode lead assembly 58 may then be positioned within the end portion 56 and main shaft 62 using a conventional assembly holder 68 as shown in FIG. 11*b*. With the fill gas filling the shaft 62 to the top, the electrode lead assembly 58 may be completely immersed in the fill gas to prevent corrosion during the pinch sealing process.

In one aspect of the present invention, the fill gas may be cooled at the time the chamber is hermetically sealed to obtain a superatmospheric fill gas pressure at substantially room temperature. Care must be given to prevent contamination, e.g., by continuing to introduce fill gas into the arc tube during the cooling process.

Figure 12:
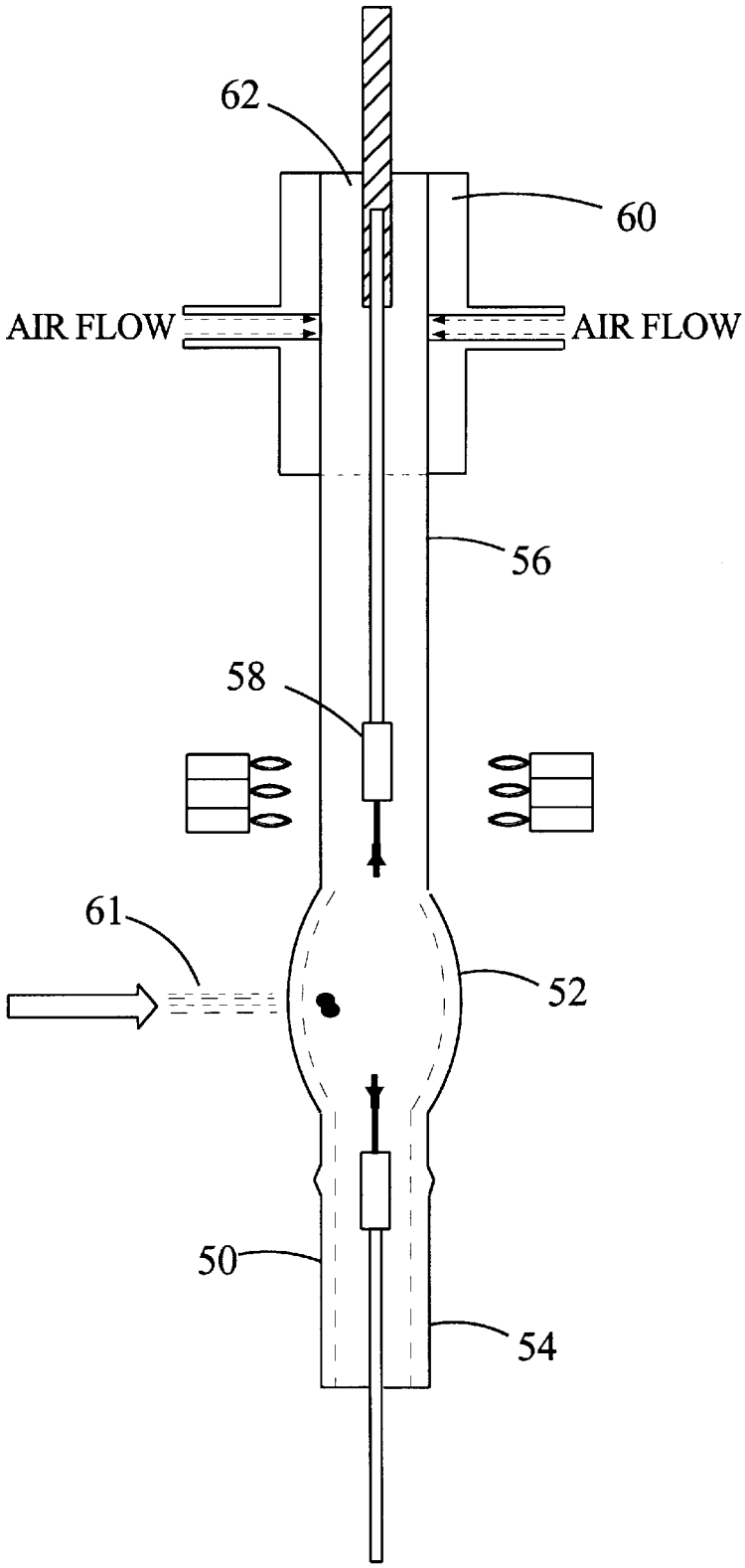
FIG. 12 illustrates the steps of positioning the electrode lead assembly and pinch sealing the second end portion of the arc tube according to another aspect of the present invention.
Figure 5:
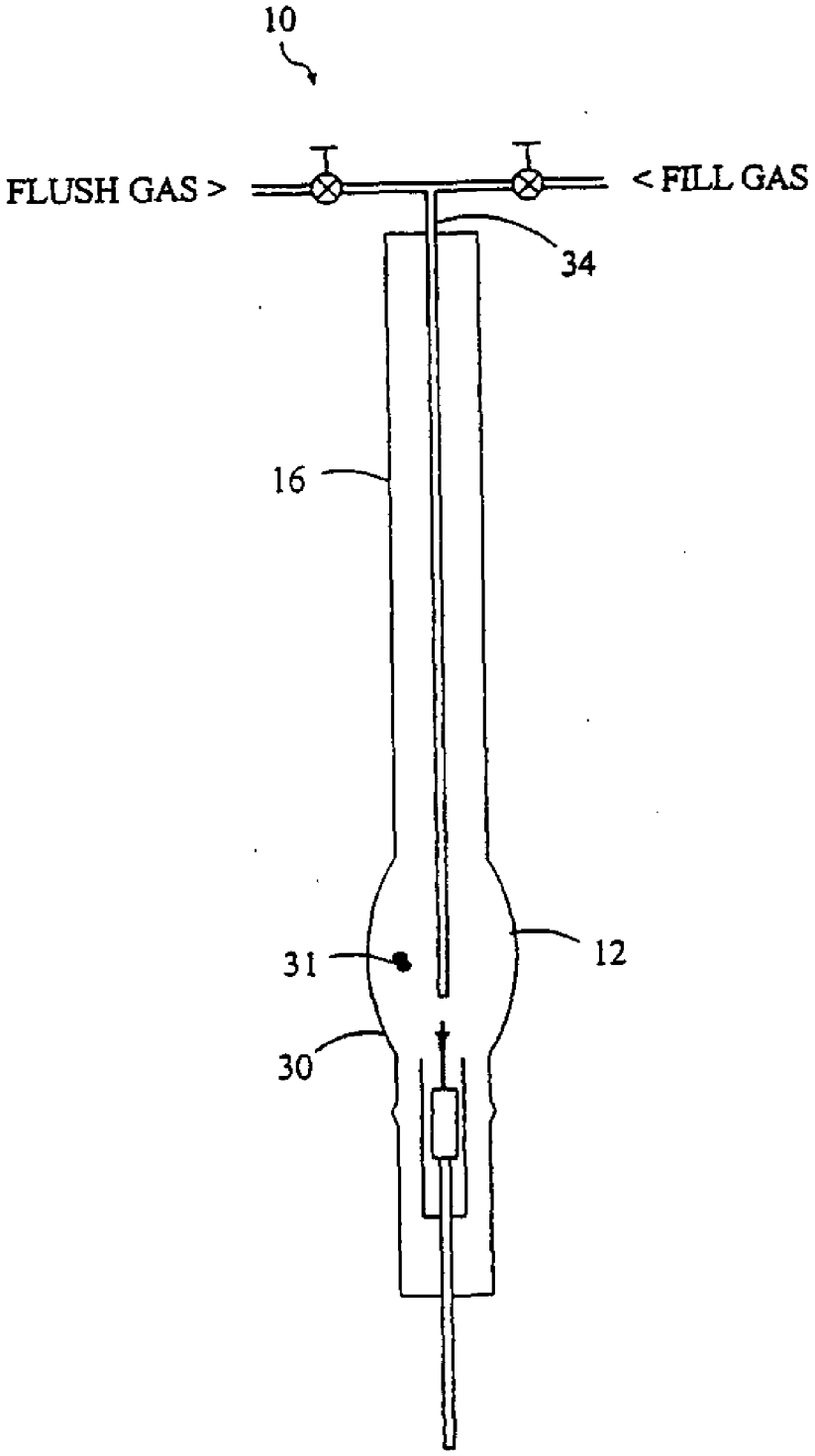
Figure 12:
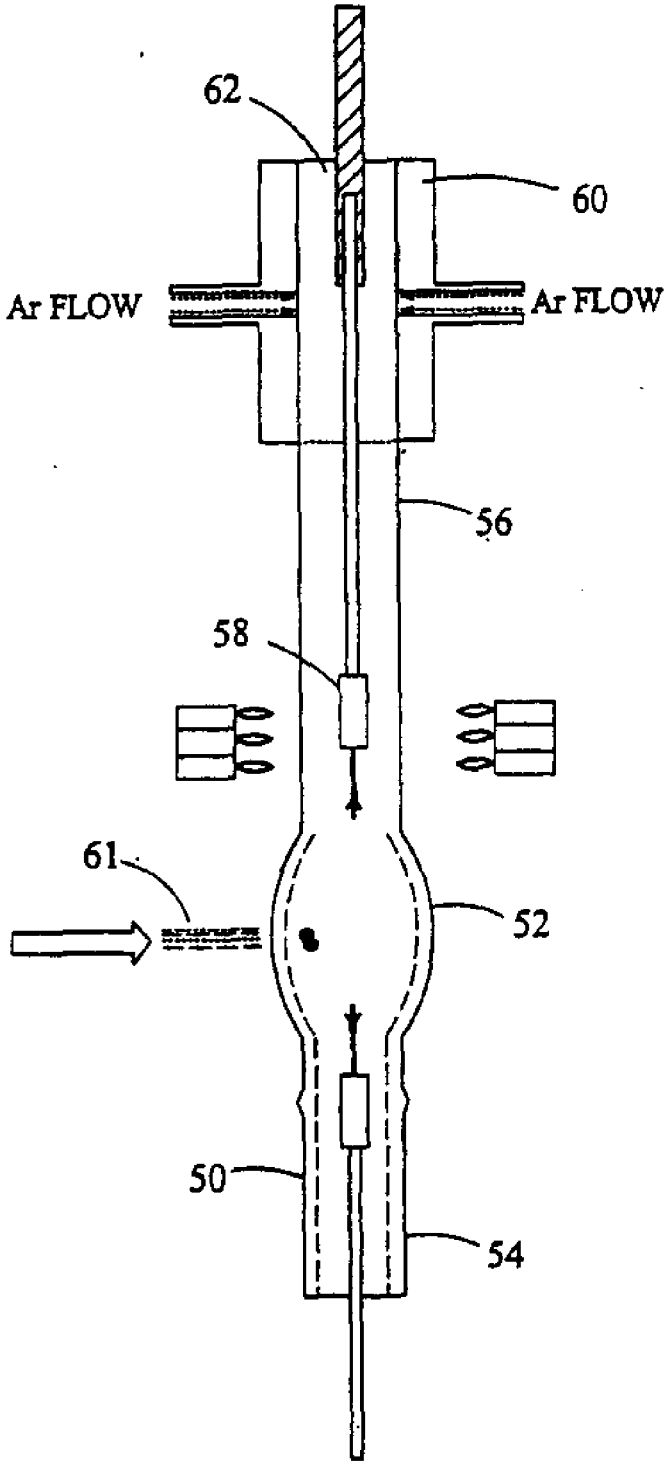

FIG. 12 illustrates the embodiment of the present invention wherein the fill gas is xenon. With reference to FIG. 12, a blanket of argon may be placed over the xenon which now fills the shaft 52 to the top. The temperature of a portion of the chamber 52 may then be reduced to a temperature below the freezing point of xenon, i.e., temperatures of about −112° C. or lower, by any conventional means such as by a liquid nitrogen spray 61. Once the entire volume of xenon within the interior of the body 50 and shaft 62 is frozen into the chamber, the end portion 56 may be sealed by any conventional sealing process such as pinch or shrink sealing. The electrode lead assembly 58 will remain immersed in a non-reactive gas during the sealing process by maintaining the argon blanket over the xenon which will fill the voids within the interior of the body 50 and shaft 62 created by the freezing of the xenon into the chamber 52. Small amounts of argon may be sealed within the chamber 52, but will not affect the performance of the lamp.

In this embodiment, the final fill pressure of the xenon in the sealed arc tube at substantially room temperature, is determined by the ratio of the volume of the interior of the arc tube body 50 and the shaft 62, to the volume of the sealed chamber 52. The volume of the shaft 62 may be varied to obtain the desired final fill pressure.

In another embodiment of the present invention, a flow of gas comprising a mixture of at least two non-reactive gases may be introduced into the chamber 52. The temperature of the chamber may be reduced below the freezing point of one of the gases, but remain above the freezing point of the other gas so that one of the gases will freeze and remain in the chamber while the gas will continue to flow. The final fill pressure may be determined by controlling the composition of the gas mixture and the flow rate of the gas. Once the desired amount of gas has been frozen into the chamber, the flow may be stopped and the end portion 58 may be sealed to thereby hermetically seal the chamber 52.

For example, the gas may comprise xenon and argon. If the temperature of the chamber is reduced to below the freezing point of xenon but remain above the freezing point of argon, the xenon will freeze in the chamber while the argon will continue to flow to provide a non-reactive atmosphere surrounding the second electrode lead assembly during the pinch or shrink sealing of the remaining open end portion of the arc tube.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A method of making an arc tube for a high intensity discharge lamp wherein the arc tube includes fill gas at superatmospheric pressure at substantially room temperature, said method comprising the steps of:

reducing the temperature of the fill gas in the interior of the arc tube body relative to the temperature of an uncontrolled atmosphere surrounding the body at substantially atmospheric pressure while maintaining communication between the fill gas and the surrounding atmosphere; and hermetically sealing the arc tube body while the temperature of the fill gas is reduced so that the pressure of the fill gas sealed within the interior of the arc tube will be superatmospheric when the temperature of the fill gas is no longer reduced.

2. The method of claim 1 wherein the step of reducing the temperature of the fill gas comprises the steps of freezing xenon in the chamber and providing a blanket of argon over the frozen xenon while maintaining communication between the argon and the surrounding atmosphere.

3. The method of claim 2 further comprising the step of freezing a known volume of xenon in the chamber to obtain a desired fill gas pressure when the arc tube is sealed and the xenon is no longer frozen.

4. The method of claim 1 wherein the step of reducing the temperature of the fill gas comprises the step of cooling the longitudinally central portion of the arc tube body.

5. The method of claim 1 comprising the steps of:

sealing one tubular end portion of the body;

sealing the other tubular end portion of the body to thereby form a hermetically sealed light emitting chamber between the sealed end portions; and cooling the chamber to thereby reduce the temperature of the fill gas within the chamber during the step of sealing the other tubular end portion.

6. The method of claim 1 wherein the end portions are pinch-sealed.

7. The method of claim 1 wherein the end portions are shrink-sealed.

8. The method of claim 1 wherein the fill gas is inert and the surrounding atmosphere is air.

9. The method of claim 8 wherein the inert fill gas comprises xenon.

10. The method of claim 1 wherein the pressure of the fill gas sealed within the chamber is greater than ten atmospheres at substantially room temperature.

11. The method of claim 1 wherein the fill gas pressure is between about five atmospheres and thirty atmospheres at substantially room temperature.

12. The method of claim 1 wherein the step of hermetically sealing the arc tube body comprises the step of sealing a tubulation extending from a light emitting chamber of the arc tube.

13. The method of claim 1 wherein the arc tube body comprises a light emitting chamber having a single open end.

14. The method of claim 1 wherein the arc tube body comprises ceramic material.

15. The method of claim 1 wherein the arc tube body comprises quartz.

16. The method of claim 1 wherein the step of hermetically sealing the arc tube body comprises the steps of positioning one or more electrode lead assemblies in an open end portion of the body, and sealing the end portion around the one or more electrode lead assemblies positioned therein to thereby fix the position of the one or more electrode lead assemblies and hermetically seal the arc tube body.

17. A method of making an arc tube for a high intensity discharge lamp having fill gas hermetically sealed within the light emitting chamber of the arc tube wherein the pressure of the fill gas is greater than one atmosphere at substantially room temperature, said method comprising the steps of:

providing a flow of fill gas into the chamber, the fill gas comprising at least two non-reactive gases;

cooling the chamber to a temperature below the freezing point of at least one of the gases comprising the fill gas, but greater than the freezing point of at least one other gas comprising the fill gas so that an amount of at least one of the gases will freeze within the chamber; and hermetically sealing the chamber when the desired amount of gas is frozen therein.

18. The method of claim 17 wherein the fill gas comprises xenon and argon.

19. The method of claim 18 wherein the fill gas comprises at least one part per million xenon.

20. The method of claim 17 wherein the flow rate of the fill gas is at least about one tenth of a standard liter per second but not greater than about one hundred standard liters per second.

21. The method of claim 17 wherein the fill gas flows into the chamber through an open tubular end portion of the arc tube.

22. The method of claim 17 wherein the step of hermetically sealing the chamber comprises the steps of positioning one or more electrode lead assemblies in an open end portion of the body, and sealing the end portion around the one or more electrode lead assemblies positioned therein to thereby fix the position of the one or more electrode lead assemblies and hermetically seal the light emitting chamber of the arc tube body.

23. A method of making a tipless arc tube having a hermetically sealed light emitting chamber containing a fill gas at superatmospheric pressure, said method comprising the steps of:

placing the tipless chamber in a gaseous atmosphere;

flushing and filling the chamber with the fill gas through an open end portion of the arc tube;

reducing the temperature of the fill gas within the chamber;

providing a blanket of non-reactive gas over the fill gas while maintaining communication between the non-reactive gas and the gaseous atmosphere surrounding the chamber; and hermetically sealing the chamber by sealing the end portion, the composition of the non-reactive gas being different from the composition of the gaseous atmosphere surrounding the arc tube.

24. The method of claim 23 wherein the non-reactive gas is argon and the atmosphere surrounding the arc tube is air.

25. The method of claim 24 wherein the fill gas is xenon.

26. A method of making an arc tube for a HID lamp containing a superatmospheric fill of xenon, said method comprising the steps of:

(a) providing an arc tube body comprising open tubular end portions;

(b) positioning the arc tube body so that the tubular end portions are substantially vertical;

(c) positioning a first electrode lead assembly in the lower open tubular end portion while flushing the interior of the body with a non-reactive gas introduced through the upper open tubular end portion;

(c) hermetically sealing the lower tubular end portion and fixing the position of the first electrode lead assembly relative to the arc tube body by:

(i) heating a portion of the lower tubular end portion, and (ii) pinch-sealing the heated portion of the lower tubular end portion around the portion of the assembly positioned therein;

(d) introducing the lamp fill material into the interior of the arc tube body through the upper tubular end portion;

(e) filling the interior of the arc tube body with xenon through the upper tubular end portion;

(f) providing a blanket of non-reactive gas over the xenon through the upper tubular end portion;

(g) freezing the xenon in the interior of the arc tube body;

(h) positioning a second electrode lead assembly in the upper tubular end portion; and (j) hermetically sealing the upper tubular end portion and fixing the position of the second electrode lead assembly relative to the arc tube body by:

(i) heating a portion of the upper tubular end portion while maintaining communication between the blanket of non-reactive gas and the atmosphere surrounding the arc tube body through the upper tubular end portion, and (ii) pinch-sealing the heated portion of the upper tubular end portion around the portion of the assembly positioned therein, the sealing of the upper end portion being the final seal to hermetically seal the interior of the arc tube body.

27. The method of claim 26 wherein the non-reactive gas is argon.

28. A method of making an arc tube for a high intensity discharge lamp comprising the steps of:

providing a quartz arc tube body comprising a bulbous light emitting chamber intermediate tubular end portions of substantially the same length;

sealing an electrode lead assembly in one end portion;

introducing the lamp fill material, mercury, and an inert fill gas into the chamber through the other end portion;

reducing the temperature of the fill gas within the chamber relative to the atmosphere surrounding the chamber at substantially atmospheric pressure; and sealing an electrode lead assembly in the other end to thereby hermetically seal the chamber while the temperature of the fill gas is reduced so that the pressure of the fill gas sealed within the chamber will be superatmospheric when the temperature of the fill gas is no longer reduced.

29. A method of sealing an arc tube having a bulbous chamber and tubular end portions comprising the steps of:

(a) pinch sealing a first electrode lead assembly in a first end portion while passing a controlled atmosphere through the end portion;

(b) inserting fill material into the chamber through the other tubular end portion;

(c) positioning a second electrode lead assembly partially within the lower end of a removable passageway;

(d) sealably mating the lower end of the removable passageway to the other tubular end portion to thereby extend the effective length of the end portion and to position the second electrode lead assembly within the other end portion;

(e) passing a sufficient volume of a controlled atmosphere through the passageway and the other tubular end portion into the arc tube to substantially eliminate the uncontrolled atmosphere therefrom;

(f) reducing the temperature of the chamber below the freezing point of at least one of the gases in the controlled atmosphere to thereby freeze an amount of gas in the chamber while maintaining the passageway and other tubular end portion filled with the controlled atmosphere;

(g) sealing the second electrode lead assembly in the other end portion while maintaining the upper end of the passageway in communication with an uncontrolled atmosphere; and (h) removing the passageway.

30. The method of claim 29 wherein the gas frozen in the chamber is xenon.

31. The method of claim 29 wherein the controlled atmosphere comprises xenon and argon.

32. The method of claim 31 wherein the controlled atmosphere comprises krypton.

33. The method of claim 29 wherein the pressure of the gas sealed within the chamber is between about five atmospheres and thirty atmospheres at substantially room temperature.

34. A method of claim 29 wherein the compiled atmosphere is passed through the passageway at a rate of at least about one hundredth of a standard liter per second but not greater than about one hundred standard liters per second.

35. The method to claim 23 wherein the composition of the fill gas is the same as the composition of the non-reactive gas blanket.

36. The method of claim 35 wherein the fill gas and the non-reactive gas blanket are xenon.

37. The method of claim 26 wherein the non-reactive gas is xenon.

38. The method of claim 26 wherein the non-reactive gas is inert.

39. The method of claim 26 wherein the pressure of the gas sealed within the interior of the arc tube body is between about five atmospheres and thirty atmospheres.

40. The method of claim 26 wherein the lamp fill material comprises mercury and one or more metal halides.

* * * * *

UNITED STATES PATENT AND TRADEMARK OFFICE

CERTIFICATE OF CORRECTION

PATENT NO. : 6,517,404 B1 
DATED : February 11, 2003
INVENTOR(S) : Lamouri et al.

It is certified that error appears in the above-identified patent and that said Letters Patent is hereby corrected as shown below:

The title page, showing the illustrative figure should be deleted to be replaced with the attached title page.

Title page,
Item [57], ABSTRACT,
Line 4, "hermetically scaling the arc tube," should read -- hermetically sealing the arc tube. --

Drawing sheet, consisting of Figs. 5 and 12, should be deleted to be replaced with the drawing sheet, consisting of Figs. 5 and 12, as shown on the attached page.

Signed and Sealed this

Ninth Day of March, 2004

JON W. DUDAS
*Acting Director of the United States Patent and Trademark Office*

(12) United States Patent
Lamouri et al.

(10) Patent No.: US 6,517,404 B1
(45) Date of Patent: Feb. 11, 2003

(54) HIGH INTENSITY DISCHARGE LAMPS, ARC TUBES AND METHODS OF MANUFACTURE

(75) Inventors: Abbas Lamouri, Fairview Park; Juris Sulcs, Chagrin Falls; Yongwei Gu, Solon, all of OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 09/866,700

(22) Filed: May 30, 2001

Related U.S. Application Data

(63) Continuation-in-part of application No. 09/800,669, filed on Mar. 8, 2001.

(51) Int. Cl.[7] ..... H01J 9/395; H01J 9/40
(52) U.S. Cl. ..... 445/26; 445/39; 445/43
(58) Field of Search ..... 445/26, 39, 43

(56) References Cited

U.S. PATENT DOCUMENTS 3,211,511 A * 10/1965 Levand ..... 445/27
4,799,912 A * 1/1989 Salgo ..... 445/26
5,075,587 A 12/1991 Pabst et al.
5,108,333 A 4/1992 Heider et al.
5,221,876 A 6/1993 Bergman et al.
5,505,648 A 4/1996 Nagasawa et al.
5,668,441 A 9/1997 Genz

OTHER PUBLICATIONS

Hansler and Davenport, Journal of the Illuminating Engineering Society, pp. 109–122, Fall, 1985.

* cited by examiner

*Primary Examiner*—Kenneth J. Ramsey
(74) *Attorney, Agent, or Firm*—Duane Morris LLP; D. Joseph English; L. Lawton Rogers, III

(57) ABSTRACT

A tipless arc tube for a high intensity discharge lamp and method of manufacture wherein the arc tube may remain open to an uncontrolled atmosphere during the step of hermetically sealing the arc tube. The novel arc tube and method obviate the need to perform any process steps within a controlled atmosphere. The pressure of the fill gas sealed within the arc tube may be controlled by controlling the temperature of the fill gas during the step of hermetically sealing the arc tube. The novel arc tube and method obviate the need to use a pump to control the fill gas pressure.

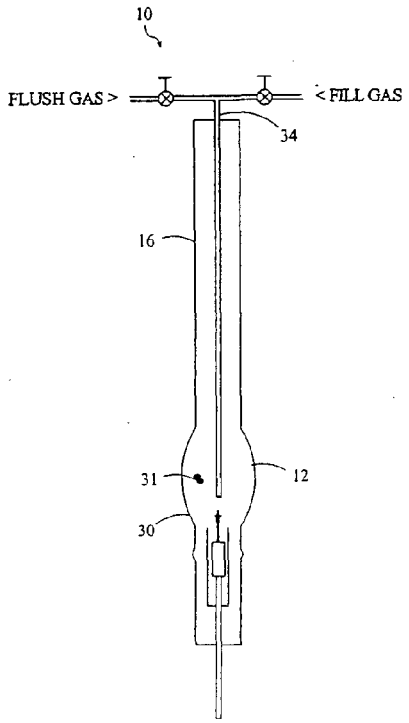

40 Claims, 15 Drawing Sheets